US009890779B2

(12) United States Patent
Ahn et al.

(10) Patent No.: US 9,890,779 B2
(45) Date of Patent: Feb. 13, 2018

(54) LINEAR COMPRESSOR

(71) Applicant: LG ELECTRONICS INC., Seoul (KR)

(72) Inventors: Kwangwoon Ahn, Seoul (KR); Donghan Kim, Seoul (KR); Seongho Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 351 days.

(21) Appl. No.: 14/644,988

(22) Filed: Mar. 11, 2015

(65) Prior Publication Data

US 2015/0369237 A1 Dec. 24, 2015

(30) Foreign Application Priority Data

Jun. 24, 2014 (KR) ..... 10-2014-0077507

(51) Int. Cl.
*F04B 53/00* (2006.01)
*F04B 39/02* (2006.01)
(Continued)

(52) U.S. Cl.
CPC ..... *F04B 53/1077* (2013.01); *F04B 35/045* (2013.01); *F04B 39/0292* (2013.01);
(Continued)

(58) Field of Classification Search
CPC ..... F04B 39/122; F04B 39/0005; F04B 39/0292; F04B 39/126; F04B 39/16; F04B 53/008; F04B 53/20; F04B 53/1077; F04B 35/045; F04B 39/041; F16C 29/025; F16C 32/0622; F16C 32/06
USPC ..... 92/169.1; 417/443
See application file for complete search history.

(56) References Cited

U.S. PATENT DOCUMENTS 7,913,613 B2 * 3/2011 Muth ..... F04B 35/045 92/169.1
8,398,752 B2 * 3/2013 Brownstein ..... B01D 39/1623 28/107
(Continued)

FOREIGN PATENT DOCUMENTS

CN 101087949 12/2007
CN 101091043 12/2007
(Continued)

OTHER PUBLICATIONS

European Search Report dated Nov. 20, 2015.
Chinese Office Action dated Mar. 3, 2017. (English Translation).

*Primary Examiner* — Nathan Zollinger
(74) *Attorney, Agent, or Firm* — Ked & Assocates LLP

(57) ABSTRACT

A linear compressor is provided. The linear compressor may include a shell including a suction inlet, a cylinder provided in the shell to define a compression space for a refrigerant, a piston reciprocated in an axial direction within the cylinder, a discharge valve provided at one side of the cylinder to selectively discharge the refrigerant compressed in the compression space, and at least one nozzle, through which at least a portion of the refrigerant discharged through the discharge valve may flow, the at least one nozzle being disposed in the cylinder. The at least one nozzle may include an inlet, through which the refrigerant may be introduced, and an outlet having a diameter less than a diameter of the inlet.

7 Claims, 10 Drawing Sheets

(51) Int. Cl.

| | |
|---|---|
| ***F04B 53/10*** | (2006.01) |
| ***F04B 53/20*** | (2006.01) |
| ***F04B 35/04*** | (2006.01) |
| ***F04B 39/04*** | (2006.01) |
| ***F04B 39/12*** | (2006.01) |

(52) U.S. Cl.
CPC ..... *F04B 39/041* (2013.01); *F04B 39/122* (2013.01); *F04B 53/008* (2013.01); *F04B 53/20* (2013.01)

(56) References Cited

U.S. PATENT DOCUMENTS

| | | | | |
|---|---|---|---|---|
| 2008/0008610 | A1 | 1/2008 | Muth et al. | |
| 2009/0238701 | A1* | 9/2009 | Giacchi | F04B 39/16 417/321 |
| 2010/0046866 | A1* | 2/2010 | Schubert | F04B 35/045 384/105 |
| 2010/0247308 | A1* | 9/2010 | Giacchi | B23K 26/0626 415/229 |

FOREIGN PATENT DOCUMENTS

| | | |
|---|---|---|
| CN | 103629082 | 3/2014 |
| DE | 10 2004 061 941 | 7/2006 |
| DE | 10 2012 104 163 | 8/2013 |
| EP | 2 700 816 | 2/2014 |
| KR | 10-2009-0044884 A | 5/2009 |
| WO | WO 2013/071382 | 5/2013 |

* cited by examiner

LINEAR COMPRESSOR

CROSS-REFERENCE TO RELATED APPLICATION

The present application claims priority under 35 U.S.C. 119 and 35 U.S.C. 365 to Korean Patent Application No. 10-2014-0077507, filed in Korea on Jun. 24, 2014, which is hereby incorporated by reference in its entirety.

BACKGROUND

1. Field

A linear compressor is disclosed herein.

2. Background

Cooling systems are systems in which a refrigerant is circulated to generate cool air. In such a cooling system, processes of compressing, condensing, expanding, and evaporating the refrigerant may be repeatedly performed. For this, the cooling system may include a compressor, a condenser, an expansion device, and an evaporator. The cooling system may be installed in a refrigerator or air conditioner, which is a home appliance.

In general, compressors are machines that receive power from a power generation device, such as an electric motor or turbine, to compress air, a refrigerant, or various working gases, thereby increasing in pressure. Compressors are being widely used in home appliances or industrial fields.

Compressors may be largely classified into reciprocating compressors, in which a compression space into and from which a working gas, such as a refrigerant, is suctioned and discharged, is defined between a piston and a cylinder to allow the piston to be linearly reciprocated in the cylinder, thereby compressing the working gas; rotary compressors, in which a compression space into and from which a working gas is suctioned or discharged, is defined between a roller that eccentrically rotates and a cylinder to allow the roller to eccentrically rotate along an inner wall of the cylinder, thereby compressing the working gas; and scroll compressors, in which a compression space into and from which a working gas is suctioned or discharged, is defined between an orbiting scroll and a fixed scroll to compress the working gas while the orbiting scroll rotates along the fixed scroll. In recent years, a linear compressor, which is directly connected to a drive motor and in which a piston is linearly reciprocated, to improve compression efficiency without mechanical losses due to movement conversion and having simple structure, is being widely developed. The linear compressor may suction and compress a working gas, such as a refrigerant, while the piston is linearly reciprocated in a sealed shell by a linear motor and then discharge the refrigerant.

The linear motor is configured to allow a permanent magnet to be disposed between an inner stator and an outer stator. The permanent magnet may be linearly reciprocated by an electromagnetic force between the permanent magnet and the inner (or outer) stator. As the permanent magnet operates in a state in which the permanent magnet is connected to the piston, the refrigerant may be suctioned and compressed while the piston is linearly reciprocated within the cylinder, and then the refrigerant may be discharged.

The present Applicant filed for a patent (hereinafter, referred to as "prior art document" and then registered the patent with respect to the linear compressor, as Korean Patent No. 10-1307688, filed in Korea on Sep. 5, 2013 and entitled "linear compressor", which is hereby incorporated by reference.

The linear compressor according to the prior art document includes a shell to accommodate a plurality of components. A vertical height of the shell may be somewhat large, as illustrated in FIG. 2 of the prior art document. Also, an oil supply assembly to supply oil between a cylinder and a piston may be disposed within the shell. When the linear compressor is provided in a refrigerator, the linear compressor may be disposed in a machine chamber provided at a rear side of the refrigerator.

In recent years, a major concern of customers is increasing an inner storage space of the refrigerator. To increase the inner storage space of the refrigerator, it may be necessary to reduce a volume of the machine room. To reduce the volume of the machine room, it may be important to reduce a size of the linear compressor.

However, as the linear compressor disclosed in the prior art document has a relatively large volume, the linear compressor in the prior art document is not applicable to a refrigerator, for which increased inner storage space is sought.

To reduce the size of the linear compressor, it may be necessary to reduce a size of a main component of the compressor. In this case, the compressor may deteriorate in performance.

To compensate for the deteriorated performance of the compressor, it may be necessary to increase a drive frequency of the compressor. However, the more the drive frequency of the compressor is increased, the more a friction force due to oil circulating into the compressor increases, deteriorating performance of the compressor.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. The embodiments may, however, be embodied in many different forms and should not be construed as being limited to the embodiments set forth herein; rather, alternate embodiments falling within the spirit and scope will fully convey the concept to those skilled in the art.

Figure 1:
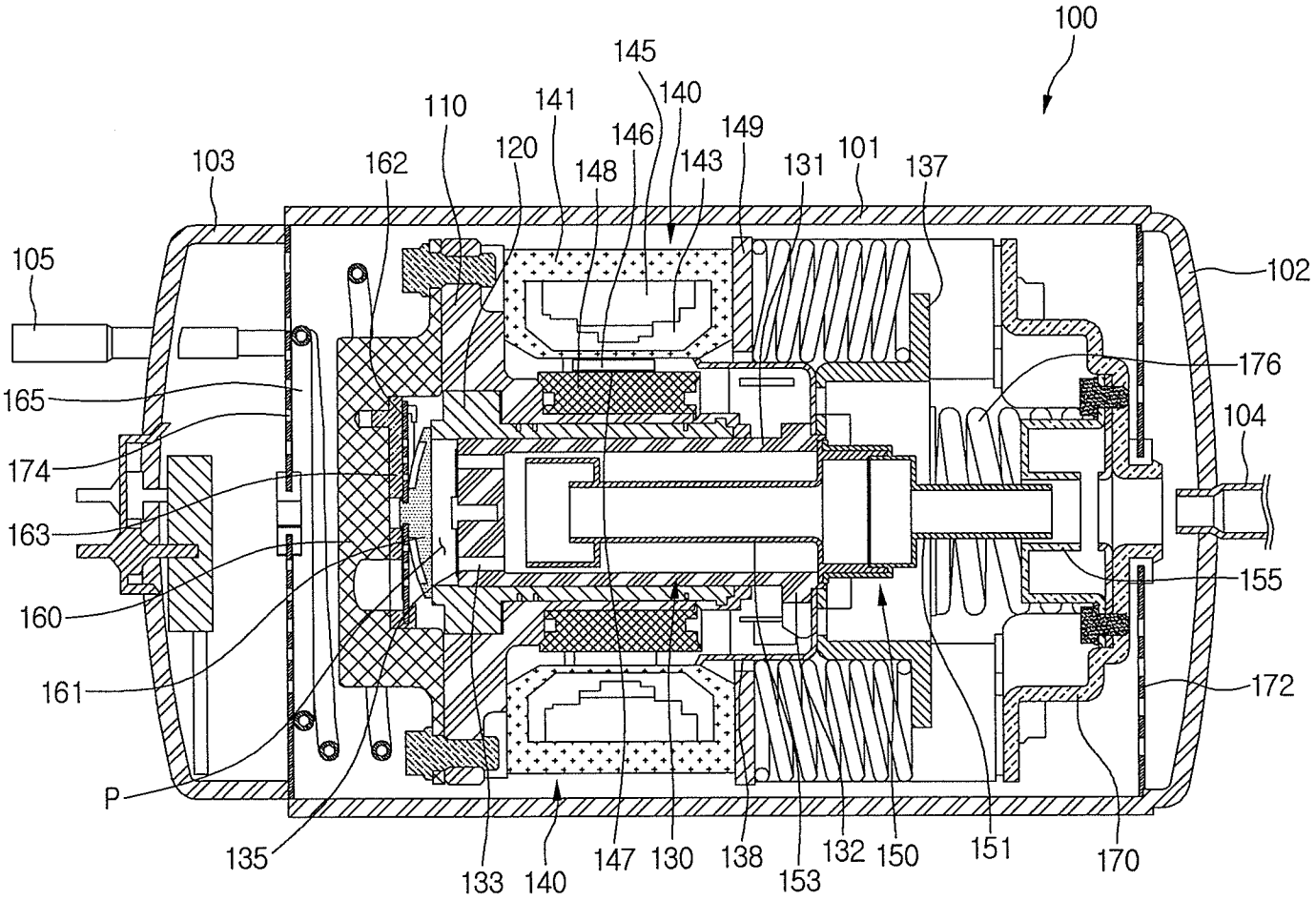
FIG. 1 is a cross-sectional view of a linear compressor according to an embodiment.

FIG. 1 is a cross-sectional view of a linear compressor according to an embodiment. Referring to FIG. 1, the linear compressor 100 according to an embodiment may include a shell 101 having an approximately cylindrical shape, a first cover 102 coupled to a first side of the shell 101, and a second cover 103 coupled to a second side of the shell 101. For example, the linear compressor 100 may be laid out in a horizontal direction. The first cover 102 may be coupled to a right or first lateral side of the shell 101, and the second cover 103 may be coupled to a left or second lateral side of the shell 101, with reference to FIG. 1. Each of the first and second covers 102 and 103 may be understood as one component of the shell 101.

The linear compressor 100 may include further a cylinder 120 provided in the shell 101, a piston 130 linearly reciprocated within the cylinder 120, and a motor assembly 140 that serves as a linear motor to apply a drive force to the piston 130. When the motor assembly 140 operates, the piston 130 may be linearly reciprocated at a high rate. The linear compressor 100 according to this embodiment may have a drive frequency of about 100 Hz, for example.

The linear compressor 100 may include a suction inlet 104, through which refrigerant may be introduced, and a discharge outlet 105, through which the refrigerant compressed in the cylinder 120 may be discharged. The suction inlet 104 may be coupled to the first cover 102, and the discharge outlet 105 may be coupled to the second cover 103.

The refrigerant suctioned in through the suction inlet 104 may flow into the piston 130 via a suction muffler 150. Thus, while the refrigerant passes through the suction muffler 150, noise may be reduced. The suction muffler 150 may include a first muffler 151 coupled to a second muffler 153. At least a portion of the suction muffler 150 may be disposed within the piston 130.

The piston 130 may include a piston body 131 having an approximately cylindrical shape, and a piston flange 132 that extends from the piston body 131 in a radial direction. The piston body 131 may be reciprocated within the cylinder 120, and the piston flange 132 may be reciprocated outside of the cylinder 120.

The piston 130 may be formed of a non-magnetic material, such as an aluminum material, such as aluminum or an aluminum alloy. As the piston 130 may be formed of the aluminum material, a magnetic flux generated in the motor assembly 140 may not be transmitted into the piston 130, and thus, may be prevented from leaking outside of the piston 130. The piston 130 may be manufactured by a forging process, for example.

The cylinder 120 may be formed of a non-magnetic material, such as an aluminum material, such as aluminum or an aluminum alloy. The cylinder 120 and the piston 130 may have a same material composition, that is, a same kind of material and composition.

As the cylinder 120 may be formed of the aluminum material, a magnetic flux generated in the motor assembly 200 may not be transmitted into the cylinder 120, and thus, may be prevented from leaking outside of the cylinder 120. The cylinder 120 may be manufactured by an extruding rod processing process, for example.

As the piston 130 may be formed of the same material as the cylinder 120, the piston 130 may have a same thermal expansion coefficient as the cylinder 120. When the linear compressor 100 operates, a high-temperature (a temperature of about 100° C.) environment may be created within the shell 100. Thus, as the piston 130 and the cylinder 120 may have the same thermal expansion coefficient, the piston 130 and the cylinder 120 may be thermally deformed by a same degree. As a result, the piston 130 and the cylinder 120 may be thermally deformed with sizes and in directions different from each other to prevent the piston 130 from interfering with the cylinder 120 while the piston 130 moves.

The cylinder 120 may accommodate at least a portion of the suction muffler 150 and at least a portion of the piston 130. The cylinder 120 may have a compression space P, in which the refrigerant may be compressed by the piston 130. A suction hole 133, through which the refrigerant may be introduced into the compression space P, may be defined in a front portion of the piston 130, and a suction valve 135 to selectively open the suction hole 133 may be disposed on or at a front side of the suction hole 133. A coupling hole, to which a predetermined coupling member may be coupled, may be defined in an approximately central portion of the suction valve 135.

A discharge cover 160 that defines a discharge space or discharge passage for the refrigerant discharged from the compression space P, and a discharge valve assembly 161, 162, and 163 coupled to the discharge cover 160 to selectively discharge the refrigerant compressed in the compression space P, may be provided at a front side of the compression space P. The discharge valve assembly 161, 162, and 163 may include a discharge valve 161 to introduce the refrigerant into the discharge space of the discharge cover 160 when a pressure within the compression space P is above a predetermined discharge pressure, a valve spring 162 disposed between the discharge valve 161 and the discharge cover 160 to apply an elastic force in an axial direction, and a stopper 163 to restrict deformation of the valve spring 162.

The compression space P may be understood as a space defined between the suction valve 135 and the discharge valve 161. The suction valve 135 may be disposed at a first side of the compression space P, and the discharge valve 161 maybe disposed at a second side of the compression space P, that is, a side opposite of the suction valve 135.

Figure 3:
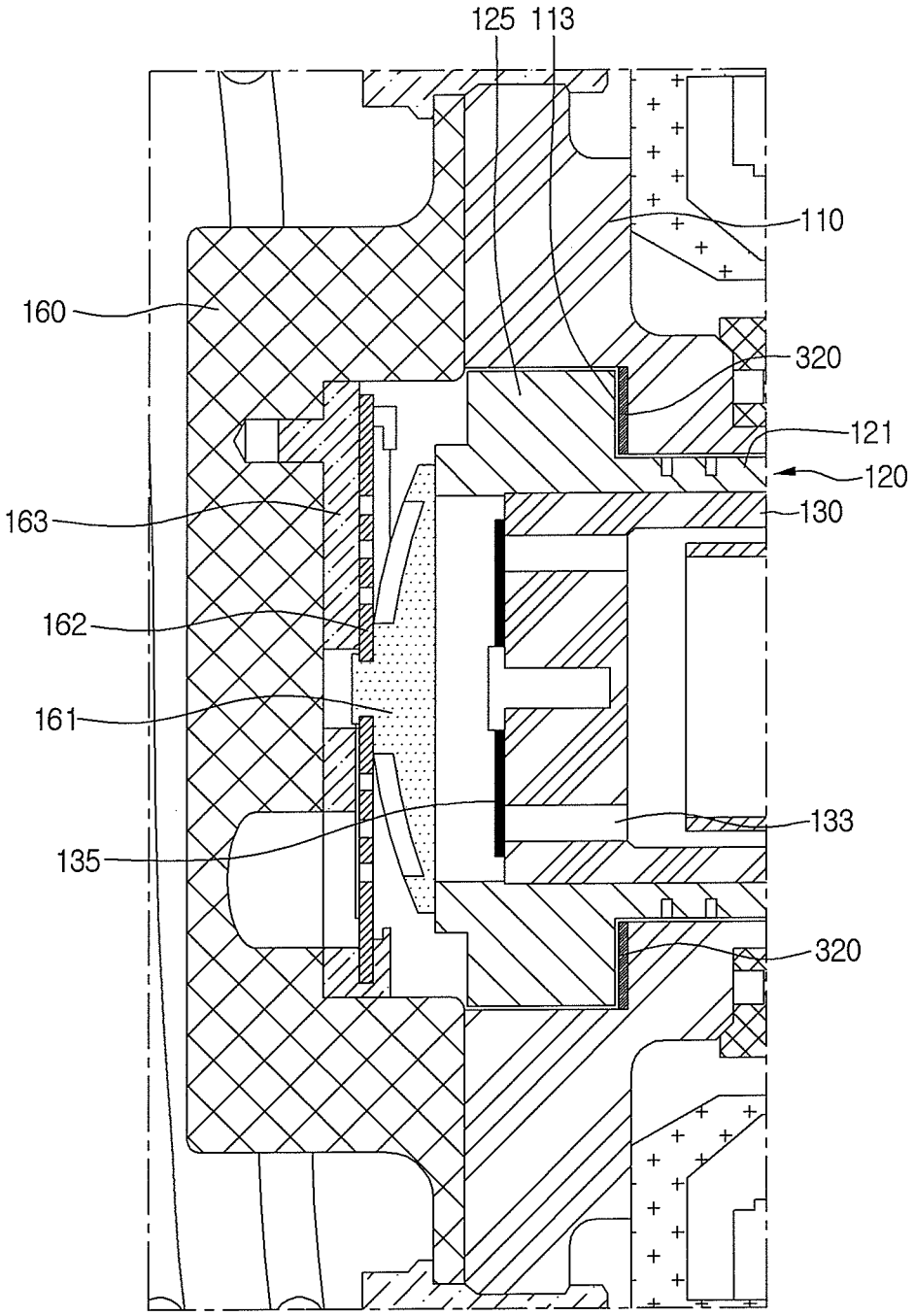
FIG. 3 is a partial cross-sectional view of the linear compressor of FIG. 1, illustrating a position of a second filter.

The term "axial direction" may refer to a direction in which the piston 130 is reciprocated, that is, a transverse direction in FIG. 3. Also, in the axial direction, a direction from the suction inlet 104 toward the discharge outlet 105, that is, a direction in which the refrigerant flows may be referred as a "frontward direction", and a direction opposite to the frontward direction may be referred as a "rearward direction". On the other hand, the term "radial direction" may refer to a direction perpendicular to the direction in which the piston 130 is reciprocated, that is, a vertical direction in FIG. 1.

The stopper 163 may be seated on the discharge cover 160, and the valve spring 162 may be seated at a rear side of the stopper 163. The discharge valve 161 may be coupled to the valve spring 162, and a rear portion or rear surface of the discharge valve 161 may be supported by a front surface of the cylinder 120. The valve spring 162 may include a plate spring, for example.

While the piston 130 is linearly reciprocated within the cylinder 120, when the pressure of the compression space P is below the predetermined discharge pressure and a predetermined suction pressure, the suction valve 135 may be opened to suction the refrigerant into the compression space P. On the other hand, when the pressure of the compression space P is above the predetermined suction pressure, the refrigerant may be compressed in the compression space P in a state in which the suction valve 135 is closed.

When the pressure of the compression space P is above the predetermined discharge pressure, the valve spring 162 may be deformed to open the discharge valve 161. The refrigerant may be discharged from the compression space P into the discharge space of the discharge cover 160.

The refrigerant flowing into the discharge space of the discharge cover 160 may be introduced into a loop pipe 165. The loop pipe 165 may be coupled to the discharge cover 160 to extend to the discharge outlet 105, thereby guiding the compressed refrigerant in the discharge space into the discharge outlet 105. For example, the loop pipe 165 may have a shape which is wound in a predetermined direction and extends in a rounded shape. The loop pipe 165 may be coupled to the discharge outlet 105.

The linear compressor 100 may further includes a frame 110. The frame 110 may fix the cylinder 120 and be coupled to the cylinder 120 by a separate coupling member, for example. The frame 110 may be disposed to surround the cylinder 120. That is, the cylinder 120 may be accommodated within the frame 110. The discharge cover 160 may be coupled to a front surface of the frame 110.

At least a portion of the high-pressure gas refrigerant discharged through the opened discharge valve 161 may flow toward an outer circumferential surface of the cylinder 120 through a space formed at a portion at which the cylinder 120 and the frame 110 are coupled to each other. The refrigerant may be introduced into the cylinder 120 through a gas inflow (see reference numeral 122 of FIG. 7) and a nozzle (see reference numeral 123 of FIG. 7), which may be defined in the cylinder 120. The introduced refrigerant may flow into a space defined between the piston 130 and the cylinder 120 to allow an outer circumferential surface of the piston 130 to be spaced apart from an inner circumferential surface of the cylinder 120. Thus, the introduced refrigerant may serve as a "gas bearing" that reduces friction between the piston 130 and the cylinder 120 while the piston 130 is reciprocated.

The motor assembly 140 may include outer stators 141, 143, and 145 fixed to the frame 110 and disposed to surround the cylinder 120, an inner stator 148 disposed to be spaced inward from the outer stators 141, 143, and 145, and a permanent magnet 146 disposed in a space between the outer stators 141, 143, and 145 and the inner stator 148. The permanent magnet 146 may be linearly reciprocated by a mutual electromagnetic force between the outer stators 141, 143, and 145 and the inner stator 148. The permanent magnet 146 may be provided as a single magnet having one polarity, or a plurality of magnets having three polarities.

The permanent magnet 146 may be coupled to the piston 130 by a connection member 138. The connection member 138 may be coupled to the piston flange 132 and be bent to extend toward the permanent 146. As the permanent magnet 146 is reciprocated, the piston 130 may be reciprocated together with the permanent magnet 146 in the axial direction.

The motor assembly 140 may further include a fixing member 147 to fix the permanent magnet 146 to the connection member 138. The fixing member 147 may be formed of a composition in which a glass fiber or carbon fiber is mixed with a resin. The fixing member 147 may surround an outside of the permanent magnet 146 to firmly maintain a coupled state between the permanent magnet 146 and the connection member 138.

The outer stators 141, 143, and 145 may include coil winding bodies 143 and 145, and a stator core 141. The coil winding bodies 143 and 145 may include a bobbin 143, and a coil 145 wound in a circumferential direction of the bobbin 145. The coil 145 may have a polygonal cross-section, for example, a hexagonal cross-section. The stator core 141 may be manufactured by stacking a plurality of laminations in the circumferential direction and be disposed to surround the coil winding bodies 143 and 145.

A stator cover 149 may be disposed at one side of the outer stators 141, 143, and 145. A first side of the outer stators 141, 143, and 145 may be supported by the frame 110, and a second side of the outer stators 141, 143, and 145 may be supported by the stator cover 149. The inner stator 148 may be fixed to a circumference of the frame 110. Also, in the inner stator 148, the plurality of laminations may be stacked in a circumferential direction outside of the frame 110.

The linear compressor 100 may further include a support 137 to support the piston 130, and a back cover 170 spring-coupled to the support 137. The support 137 may be coupled to the piston flange 132 and the connection member 138 by a predetermined coupling member, for example.

A suction guide 155 may be coupled to a front portion of the back cover 170. The suction guide 155 may guide the refrigerant suctioned through the suction inlet 104 to introduce the refrigerant into the suction muffler 150.

The linear compressor 100 may further include a plurality of springs 176, which are adjustable in natural frequency, to allow the piston 130 to perform a resonant motion. The plurality of springs 176 may include a first spring supported between the support 137 and the stator cover 149, and a second spring supported between the support 137 and the back cover 170.

The linear compressor 100 may additionally include plate springs 172 and 174 disposed, respectively, on both sides of the shell 101 to allow inner components of the compressor 100 to be supported by the shell 101. The plate springs 172 and 174 may include a first plate spring 172 coupled to the first cover 102, and a second plate spring 174 coupled to the second cover 103. For example, the first plate spring 172 may be fitted into a portion at which the shell 101 and the first cover 102 are coupled to each other, and the second plate spring 174 may be fitted into a portion at which the shell 101 and the second cover 103 are coupled to each other.

Figure 2:
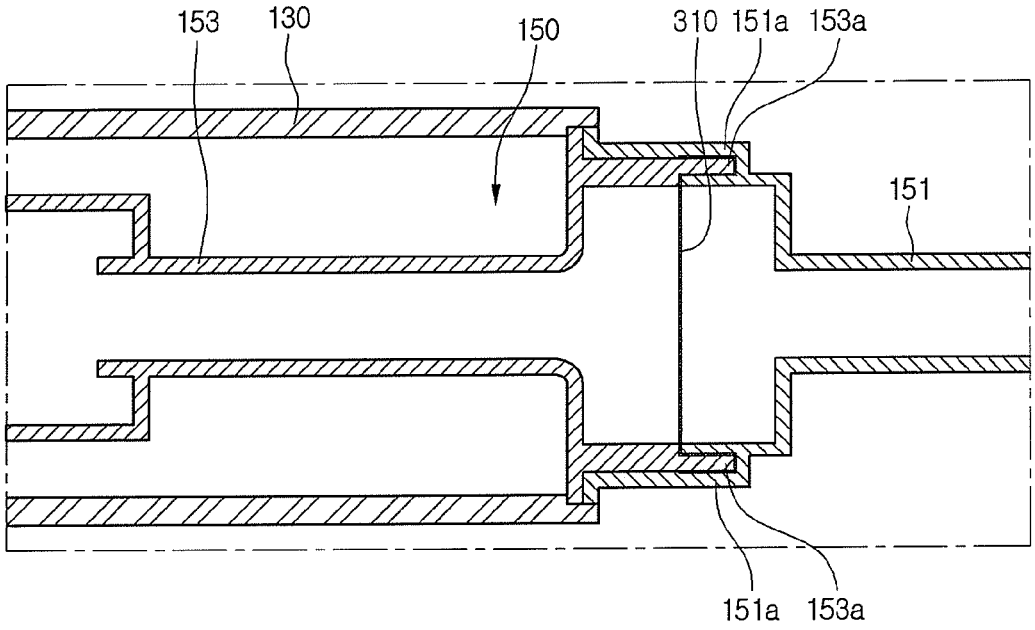
FIG. 2 is a cross-sectional view of a suction muffler of the linear compressor of FIG. 1.

FIG. 2 is a cross-sectional view of a suction muffler of the linear compressor of FIG. 1. Referring to FIG. 2, the suction muffler 150 according to this embodiment may include a first muffler 151, a second muffler 153 coupled to the first muffler 151, and a first filter 310 supported by the first and second mufflers 151 and 153.

A flow space, in which the refrigerant may flow, may be defined in each of the first and second mufflers 151 and 153. The first muffler 151 may extend from an inside of the suction inlet 104 in a direction of the discharge outlet 105, and at least a portion of the first muffler 151 may extend inside of the suction guide 155. The second muffler 153 may extend from the first muffler 151 inside of the piston body 131.

The first filter 310 may be a component disposed in the flow space to filter foreign substances. The first filter 310 may be formed of a material having a magnetic property. Thus, the foreign substances contained in the refrigerant, in particular, metallic substances, may be easily filtered.

For example, the first filter 310 may be formed of stainless steel, and thus, have a magnetic property to prevent the first filter 310 from rusting. Alternatively, the first filter 310 may be coated with a magnetic material, or a magnet may be attached to a surface of the first filter 310.

The first filter 310 may be a mesh-type structure and have an approximately circular plate shape. Each of filter holes may have a diameter or width less than a predetermined diameter or width. For example, the predetermined size may be about 25 μm.

The first muffler 151 and the second muffler 153 may be assembled with each other using a press-fit manner, for example. The first filter 310 may be fitted into a portion into which the first and second mufflers 151 and 153 are press-fitted, and then, may be assembled. For example, a groove 151*a* may be defined in one of the first and second mufflers 151 and 153, and a protrusion 153*a* inserted into the groove may be disposed on the other one of the first and second mufflers 151 and 153.

The first filter 310 may be supported by the first and second mufflers 151 and 153 in a state in which both sides of the first filter 310 are disposed between the groove 151*a* and the protrusion 153*a*. In the state in which the first filter 310 is disposed between the first and second mufflers 151 and 153, when the first and second mufflers 151 and 153 move in a direction that approach each other and then are press-fitted, both sides of the first filter 310 may be inserted and fixed between the groove 151*a* and the protrusion 153*a*.

As described above, as the first filter 310 is provided on the suction muffler 150, a foreign substance having a size greater than a predetermined size of the refrigerant suctioned through the suction inlet 104 may be filtered by the first filter 310. Thus, the first filter 310 may filter the foreign substance from the refrigerant acting as the gas bearing between the piston 130 and the cylinder 120 to prevent the foreign substance from being introduced into the cylinder 120. Also, as the first filter 310 is firmly fixed to the portion at which the first and second mufflers 151 and 153 are press-fitted, separation of the first filter 310 from the suction muffler 150 may be prevented.

Figure 4:
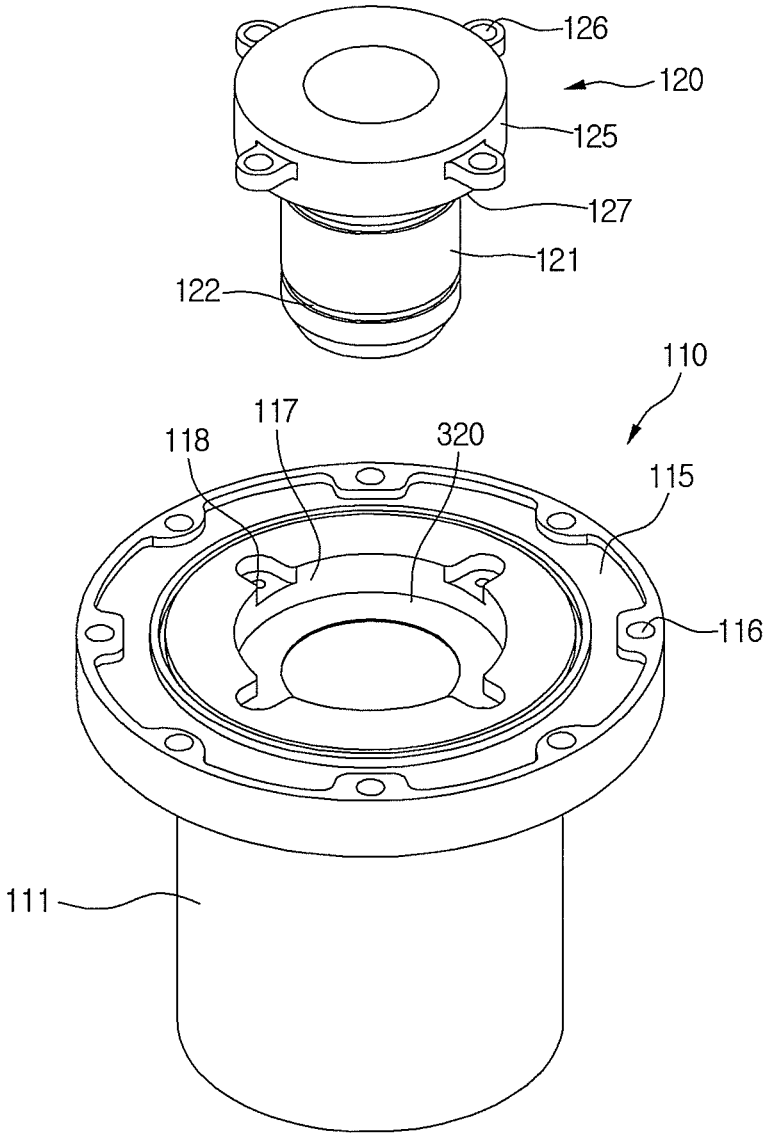
FIG. 4 is an exploded perspective view of a cylinder and a frame of the linear compressor of FIG. 1.

FIG. 3 is a partial cross-sectional view of the linear compressor of FIG. 1, illustrating a position of a second filter. FIG. 4 is an exploded perspective view of a cylinder and a frame of the linear compressor of FIG. 1.

Referring to FIGS. 3 and 4, the linear compressor 100 according to embodiments may include a second filter 320 disposed between the frame 110 and the cylinder 120 to filter a high-pressure gas refrigerant discharged through the discharge valve 161. The second filter 320 may be disposed on or at a portion of a coupled surface at which the frame 110 and the cylinder 120 are coupled to each other.

In detail, the cylinder 120 may include a cylinder body 121 having an approximately cylindrical shape, and a cylinder flange 125 that extends from the cylinder body 121 in a radial direction. The cylinder body 121 may include at least one gas inflow 122, through which the discharged gas refrigerant may be introduced. The gas inflow 122 may be recessed in an approximately circular shape along a circumferential surface of the cylinder body 121.

The at least one gas inflow 122 may comprise a plurality of gas inflows 122. The plurality of gas inflows 122 may include gas inflows (see reference numerals 122*a* and 122*b* of FIG. 6) disposed on a first side with respect to a center or central portion 121*c* of the cylinder body 121 in an axial direction, and a gas inflow (see reference numeral 122*c* of FIG. 6) disposed on a second side with respect to the center or central portion 121*c* of the cylinder body 121 in the axial direction.

One or more coupling portion 126 coupled to the frame 110 may be disposed on the cylinder flange 125. The one or more coupling portion 126 may protrude outward from an outer circumferential surface of the cylinder flange 125. Each coupling portion 126 may be coupled to a cylinder coupling hole 118 of the frame 110 by a predetermined coupling member.

The cylinder flange 125 may have a seat surface 127 seated on the frame 110. The seat surface 127 may be a rear surface of the cylinder flange 125 that extends from the cylinder body 121 in a radial direction.

The frame 110 may include a frame body 111 that surrounds the cylinder body 121, and a cover coupling portion 115 that extends in a radial direction of the frame body 111 and coupled to the discharge cover 160. The cover coupling portion 115 may have a plurality of cover coupling holes 116 in which the coupling member coupled to the discharge cover 160 may be inserted, and a plurality of the cylinder coupling holes 118, in which the coupling member coupled to the cylinder flange 125 may be inserted. The plurality of cylinder coupling holes 118 may be defined at positions that are recessed somewhat from the cover coupling portion 115.

The frame 110 may have a recess 117 recessed backward from the cover coupling portion 115 to allow the cylinder flange 125 to be inserted therein. That is, the recess 117 may be disposed to surround the outer circumferential surface of the cylinder flange 125. The recess 117 may have a recessed depth corresponding to a front to rear width of the cylinder flange 125.

A predetermined refrigerant flow space may be defined between an inner circumferential surface of the recess 117 and the outer circumferential surface of the cylinder flange 125. The high-pressure gas refrigerant discharged from the discharge valve 161 may flow toward the outer circumferential surface of the cylinder body 121 via the refrigerant flow space. The second filter 320 may be disposed in the refrigerant flow space to filter the refrigerant.

In detail, a seat 113 having a stepped portion may be disposed on or at a rear end of the recess 117. The second filter 320 having a ring shape may be seated on the seat 113.

In a state in which the second filter 320 is seated on the seat, when the cylinder 120 is coupled to the frame 110, the cylinder flange 125 may push the second filter 320 from a front side of the second filter 320. That is, the second filter 320 may be disposed and fixed between the seat of the frame 110 and the seat surface 127 of the cylinder flange 125.

The second filter 320 may prevent foreign substances in the high-pressure gas refrigerant discharged through the opened discharge valve 161 from being introduced into the gas inflow 122 of the cylinder 120 and be configured to absorb oil contained in the refrigerant thereon. For example, the second filter 320 may include a felt formed of polyethylene terephthalate (PET) fiber or an adsorbent paper. The PET fiber may have superior heat-resistance and mechanical strength. Also, a foreign substance having a size of about 2 μm or more, which is contained in the refrigerant, may be blocked.

The high-pressure gas refrigerant passing through the flow space defined between the inner circumferential surface of the recess 117 and the outer circumferential surface of the cylinder flange 125 may pass through the second filter 320. In this process, the refrigerant may be filtered by the second filter 320.

Figure 5:
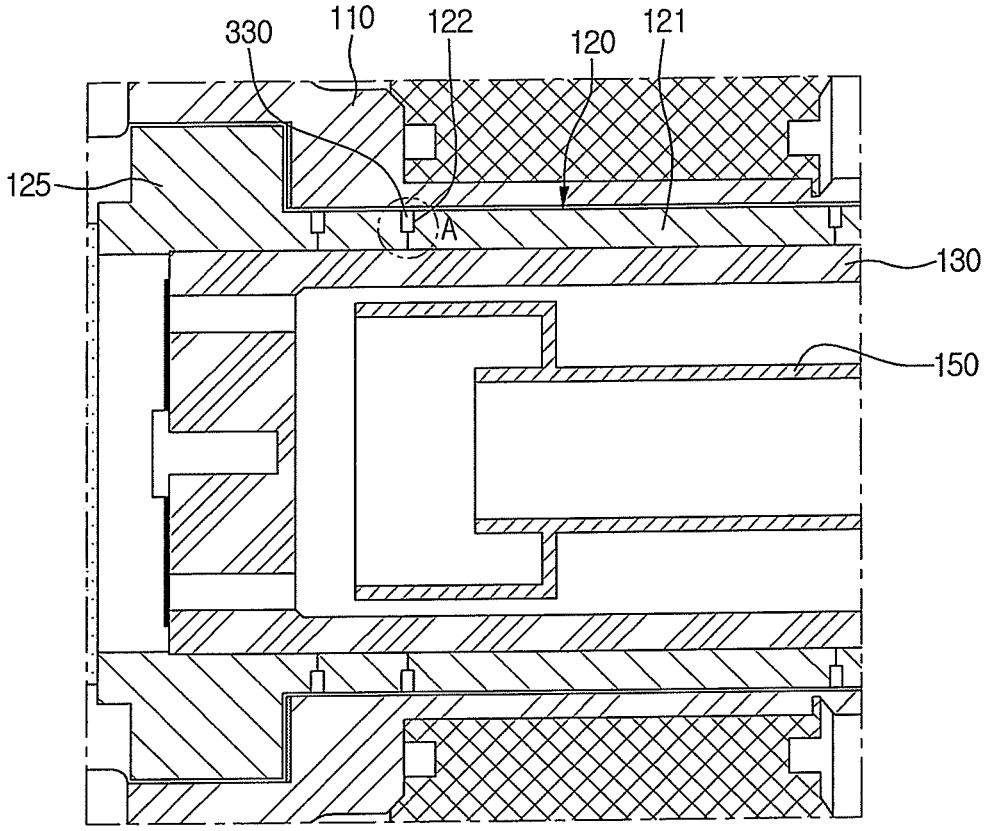
FIG. 5 is a cross-sectional view illustrating a state in which the cylinder of FIG. 4 and a piston are coupled to each other.
Figure 6:
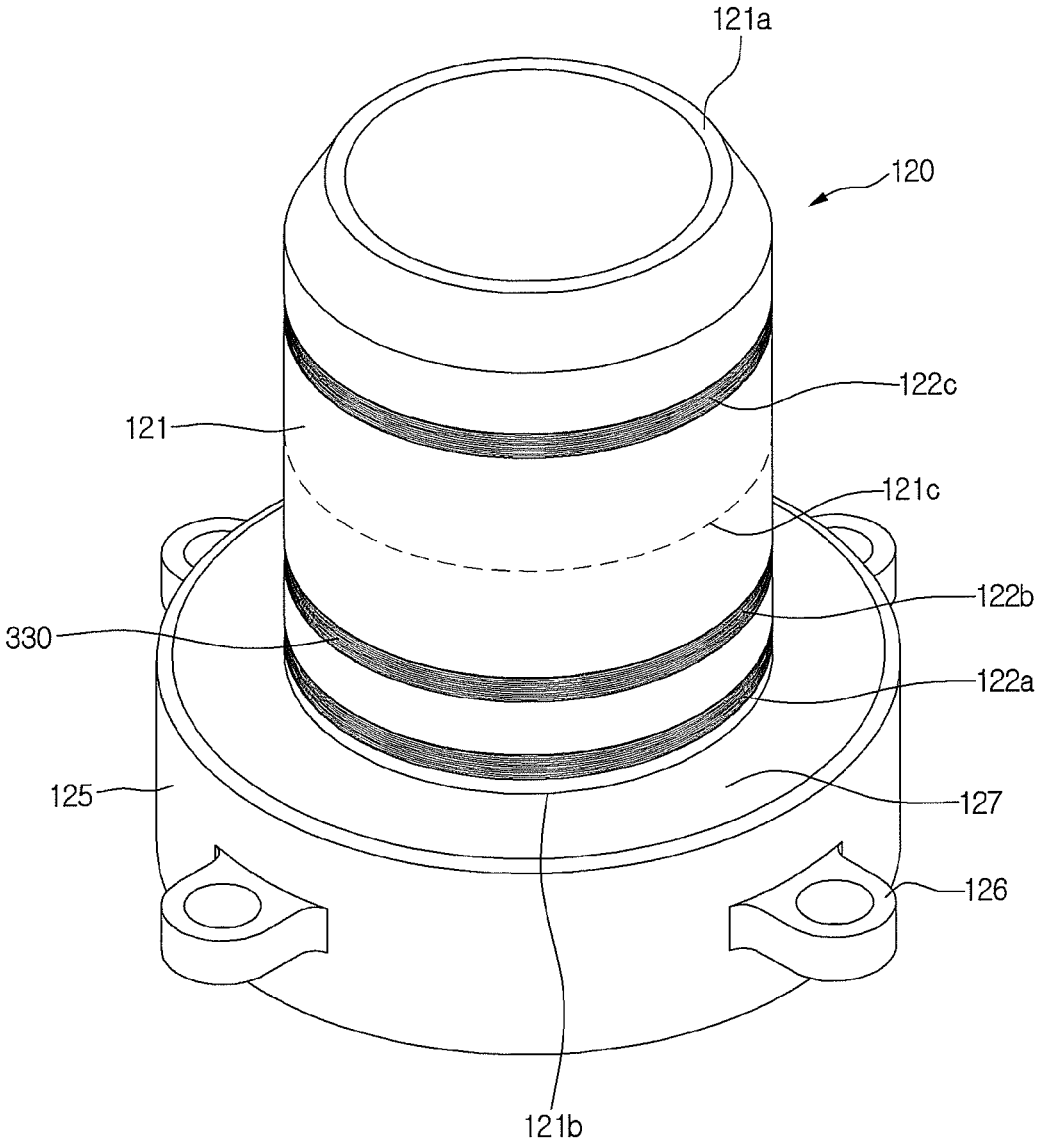
FIG. 6 is an exploded perspective view of the cylinder according to embodiments.
Figure 7:
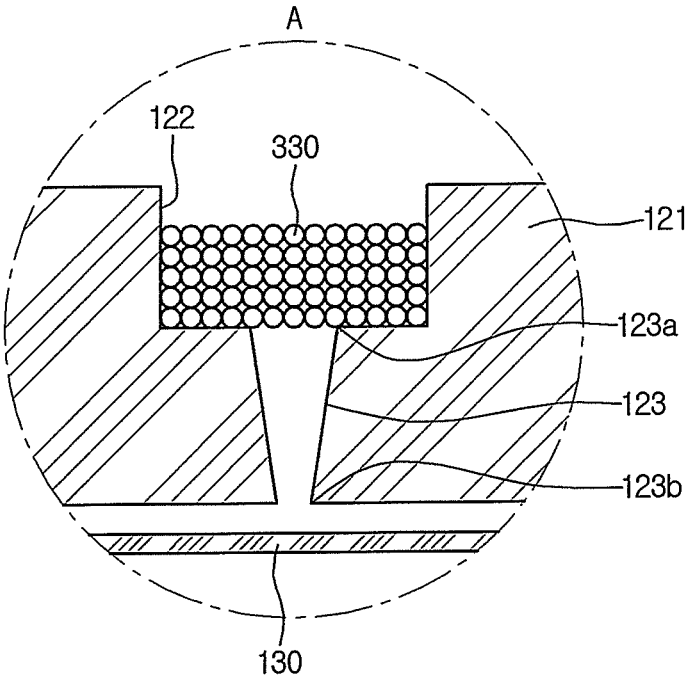
FIG. 7 is an enlarged cross-sectional view of portion A of FIG. 5.
Figure 8:
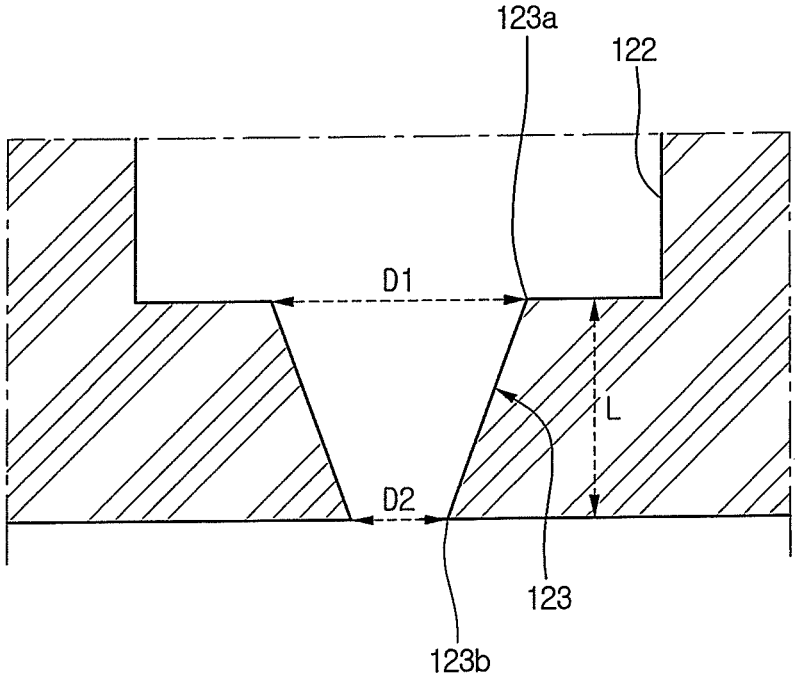
FIG. 8 is a view of a nozzle according to embodiments.

FIG. 5 is a cross-sectional view illustrating a state in which the cylinder of FIG. 4 and a piston are coupled to each other. FIG. 6 is an exploded perspective view of the cylinder according to embodiments. FIG. 7 is an enlarged cross-sectional view of portion A of FIG. 5. FIG. 8 is a view of a nozzle according to embodiments.

Referring to FIGS. 5 to 8, the cylinder 120 according to embodiments may include the cylinder body 121 having an approximately cylindrical shape to form a first body end 121*a* and a second body end 121*b*, and the cylinder flange part 125 that extends from the second body end 121*b* of the cylinder body 121 in a radial direction. The first body end 121*a* and the second body end 121*b* form both ends of the cylinder body 121 with respect to the center or central portion 121*c* of the cylinder body 121 in an axial direction.

The cylinder body 121 may includes a plurality of the gas inflows 122, through which at least a portion of the high-pressure gas refrigerant discharged through the discharge valve 161 may flow. A third filter 330 may be disposed in the plurality of gas inflows 122.

Each of the plurality of gas inflows 122 may be recessed from the outer circumferential surface of the cylinder body 121 by a predetermined depth and width. The refrigerant may be introduced into the cylinder body 121 through the plurality of gas inflows 122 and the nozzle 123.

The introduced refrigerant may be disposed between the outer circumferential surface of the piston 130 and the inner circumferential surface of the cylinder 120 to serve as the gas bearing with respect to movement of the piston 130. That is, the outer circumferential surface of the piston 130 may be maintained in a state in which the outer circumferential surface of the piston 130 is spaced apart from the inner circumferential surface of the cylinder 120 by the pressure of the introduced refrigerant.

The plurality of gas inflows 122 may include the first and second gas inflows 122*a* disposed on the first side with respect to the central portion 121*c* in the axial direction of the cylinder body 121, and a third gas inflow 122*c* disposed on the second side with respect to the central portion 121*c* in the axial direction. The first and second gas inflows 122*a* and 122*b* may be disposed at positions closer to the second body end 121*b* with respect to the central portion 121*c* in the axial direction of the cylinder body 121, and the third gas inflow 122*c* may be disposed at a position closer to the first body end 121*a* with respect to the central portion 121*c* in the axial direction of the cylinder body 121. That is, the plurality of gas inflows 122 may be provided in numbers which are not symmetrical to each other with respect to the central portion 121*c* in the axial direction of the cylinder body 121.

Referring to FIG. 6, the cylinder 120 may have a relatively high inner pressure at a side of the second body end 121*b*, which is closer to a discharge-side of the compressed refrigerant when compared to that of the first body end 121*a*, which is closer to a suction-side of the refrigerant. Thus, more gas inflows 122 may be provided at the side of the second body end 121*b* to enhance a function of the gas bearing, and relatively less gas inflows 122 may be provided at the side of the first body end 121*a*.

The cylinder body 121 may further include the nozzle 123 that extends from the plurality of gas inflows 122 toward the inner circumferential surface of the cylinder body 121. The nozzle 123 may have a width or size less than a width or size of the gas inflow 122.

A plurality of nozzles 123 may be provided along the gas inflow 122 which may extend in a circular shape. The plurality of nozzles 123 may be spaced apart from each other.

The plurality of nozzles 123 may each include an inlet 123*a* connected to the gas inflow 122, and an outlet 123*b* connected to the inner circumferential surface of the cylinder body 121. The nozzle 123 may have a predetermined length from the inlet 123*a* toward the outlet 123*b*.

The refrigerant introduced into the gas inflow 122 may be filtered by the third filter 330 to flow into the inlet 123*a* of the nozzle 123, and then, may flow toward the inner circumferential surface of the cylinder 120 along the nozzle 123. The refrigerant may be introduced into the inner space of the cylinder 120 through the outlet 123*b*.

The piston 130 may operate to be spaced apart from the inner circumferential surface of the cylinder 120, that is, be lifted or spaced from the inner circumferential surface of the cylinder 120 by the pressure of the refrigerant discharged from the outlet 123*b*. That is, the pressure of the refrigerant supplied into the cylinder 120 may provide a lifting force or pressure to the piston 130.

Referring to FIG. 8, the nozzle 123 may have a length L (mm), the inlet 123*a* may have a diameter D1 (μm), and the outlet 123*b* may have a diameter D2 (μm). A recessed depth and width of each of the plurality of gas inflows 122 and a length L of the nozzle 123 may be determined to have adequate dimensions in consideration of a rigidity of the cylinder 120, an amount of third filter 330, or an intensity in pressure drop of the refrigerant passing through the nozzle 123.

For example, if the recessed depth and width of each of the plurality of gas inflows 122 are too large, or the length L of the nozzle 123 is too short, the rigidity of the cylinder 120 may be weak. On the other hand, if the recessed depth and width of each of the plurality of gas inflows 122 are too small, an amount of third filter 330 provided in the gas inflow 122 may be too small. Also, if the length L of the nozzle 123 is too long, a pressure drop of the refrigerant passing through the nozzle 123 may be too large, it may be difficult to perform the function of the gas bearing.

The inlet 123*a* of the nozzle 123 may have the diameter D1 greater than the diameter D2 of the outlet 123*b*. In a flow direction of the refrigerant, a flow section area of the nozzle 123 may gradually decrease from the inlet 123*a* to the outlet 123*b*.

In detail, if the diameter of the nozzle 123 is too small, an amount of refrigerant, which is introduced from the nozzle 123, of the high-pressure gas refrigerant discharged through the discharge valve 161, may be too small, increasing flow loss in the compressor. On the other hand, if the diameter of the nozzle 123 is too small, the pressure drop in the nozzle 123 may increase, reducing performance of the gas bearing.

Thus, in this embodiment, the inlet 123*a* of the nozzle 123 may have the relatively large diameter D1 to reduce the pressure drop of the refrigerant introduced into the nozzle 123. In addition, the outlet 123*b* may have the relatively small diameter D2 to control an inflow amount of gas bearing through the nozzle 123 to a predetermined value or less.

The third filter 330 may prevent a foreign substance having a predetermined size or more from being introduced into the cylinder 120 and perform a function of absorbing oil contained in the refrigerant. The predetermined size may be about 1 μm. The third filter 330 may include a thread that is wound around the gas inflow 122. In detail, the thread may be formed of a polyethylene terephthalate (PET) material and have a predetermined thickness or diameter.

The thickness or diameter of the thread may be determined to have adequate dimensions in consideration of a rigidity of the thread. If the thickness or diameter of the thread is too small, the thread may be easily broken due to very weak strength thereof. On the other hand, if the thickness or diameter of the thread is too large, a filtering effect with respect to the foreign substances may be deteriorated due to a very large pore in the gas inflow 122 when the thread is wound.

For example, the thickness or diameter of the thread may be several hundreds μm. The thread may be manufactured by coupling a plurality of strands of a spun thread having several tens μm to each other, for example.

The thread may be wound several times, and an end of the thread may be fixed with a knot. A number of windings of the thread may be adequately selected in consideration of pressure drop of the gas refrigerant and a filtering effect with respect to foreign substances. If the number of windings of the thread is too large, the pressure drop of the gas refrigerant may increase. On the other hand, if the number of windings of the thread is too small, the filtering effect with respect to the foreign substances may be reduced.

Also, a tension force of the wound thread may be adequately controlled in consideration of a strain of the cylinder and fixation of the thread. If the tension force is too large, deformation of the cylinder 120 may occur. On the other hand, if the tension force is too small, the thread may not be adequately fixed to the gas inflow 122.

Figure 9:
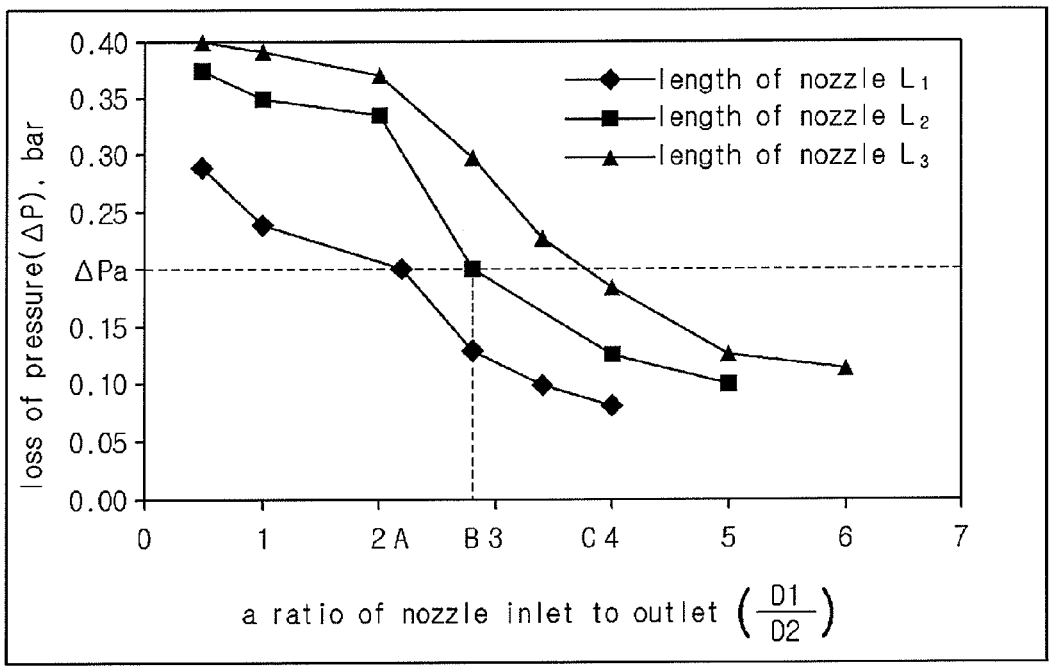
FIG. 9 is a graph illustrating variation in pressure loss depending on an inlet/outlet diameter ratio and length of the nozzle according to embodiments.

FIG. 9 is a graph illustrating variation in pressure loss depending on an inlet/outlet diameter ratio and length of the nozzle according to embodiments. The graph of FIG. 9 illustrates a degree or variation in occurrence of a pressure loss ΔP of refrigerant depending on length L of the nozzle 123 and a ratio of diameter D1 of the inlet 123*a* of the nozzle 123 to diameter D2 of the outlet 123*b* of the nozzle 123 according to embodiments.

The pressure loss ΔP may refer to a value obtained by subtracting a pressure P2 at the outlet 123*b* from a pressure P1 at the inlet 123*a*. That is, the refrigerant may be gradually reduced in pressure in a flow direction from the inlet 123*a* to the outlet 123*b* of the nozzle 123.

It may be necessary to set a pressure of the refrigerant supplied toward the inner circumferential surface of the cylinder 120 to a predetermined pressure or more. When the pressure of the refrigerant supplied toward the inner circumferential surface of the cylinder 120 is less than the preset or predetermined pressure, a sufficient pressure to lift the piston 130 may not be provided, and thus, the refrigerant may not perform the function as the gas bearing.

If a pressure (a discharge pressure) of the refrigerant discharged through the discharge valve 161 is substantially uniform under preset or predetermined conditions of external air, the pressure of the refrigerant supplied toward the inner circumferential surface of the cylinder 120 may vary according to the pressure loss that occurs in the nozzle 123. If the pressure loss occurring in the nozzle 123 is too large, the pressure of the refrigerant supplied toward the inner circumferential surface of the cylinder 120 may be less than an inner pressure of the piston 130 or may not be sufficiently larger than the inner pressure of the piston 130. Thus, the piston 130 may not be lifted within the cylinder 120, and thus, performance of the gas bearing may deteriorate.

More particularly, if external air conditions, in particular, an external air temperature is low, a difference between the suction pressure and the discharge pressure of the compressor is not large. For example, a difference between the suction pressure Ps and the discharge pressure Pd may be about 1 bar (about 100 kpa). In this case, the inner pressure of the piston 130 may be above at least the suction pressure Ps.

Also, in a state in which the discharge pressure Pd of the refrigerant discharged through the discharge valve 161 is greater by about 1 bar than the suction pressure Ps, when the pressure loss at the nozzle 123 is too large, the pressure of the refrigerant supplied toward the inner circumferential surface of the cylinder 120 is less than the inner pressure of the piston 130 or is not sufficiently larger than the inner pressure of the piston 130. As a result, performance of the refrigerant as the gas bearing may deteriorate.

Thus, in this embodiment, to maintain the pressure loss to a preset or predetermined loss value ΔPa or less, a test may be performed by changing a length of the nozzle 123 and a ratio of the inlet/outlet diameters. For example, the preset or predetermined loss value ΔPa may be set to about 0.20 bar (about 20 kpa). FIG. 9 illustrates a test result obtained under the above-described conditions.

Referring to FIG. 9, a horizontal axis in the graph may represent a ratio of the diameter D1 of the inlet 123*a* to the diameter D2 of the outlet 123*b* of the nozzle 123. Also, a vertical axis in the graph may represent a pressure loss ΔP at the nozzle 123, that is, a value obtained by subtracting the pressure at the outlet 123*b* from the pressure at the inlet 123*a*. As described above, when the pressure loss ΔP is less, performance of the refrigerant as the gas bearing may improve.

In the test, the ratio may be adjusted by changing the diameter D1 of the inlet 123*a* in a state in which the diameter D2 of the outlet 123*b* of the nozzle 123 is fixed. For example, in a state in which the diameter D2 of the outlet 123*b* is fixed to about 25 μm, the diameter D1 of the inlet 123*a* may vary to perform the test.

Also, a variation in pressure loss ΔP with respect to the ratio may be measured when the length L of the nozzle 123 is changed to lengths L1 L2, or L3. For example, L1 may be about 0.5 mm, L2 may be about 0.8 mm, and L2 may be about 1.2 mm.

The length of the nozzle 123 according to this embodiment may be selected from the lengths L1 to L3. If the length of the nozzle 123 is less than L1, rigidity of the cylinder 120 may deteriorate. On the other hand, when the length of the nozzle 123 is greater than L3, the pressure loss may increase with respect to the predetermined ratio, and material costs of the cylinder 120 may increase.

When the ratio is 1, the diameter D1 at the inlet 123*a* may be equal to the diameter D2 at the outlet 123*b*. When the ratio is less than 1, the diameter D2 at the outlet 123*b* may be greater than the diameter D1 at the inlet 123*a*. When the ratio is 1 or less than 1, the pressure loss ΔP may be significantly greater than the preset or predetermined loss valve ΔPa.

In detail, when the ratio is less than 1, for example, when the ratio is about 0.5, in a case in which the length of the nozzle 123 is L1, the pressure loss ΔP may be about 0.40 bar. Also, in a case in which the length of the nozzle 123 is L2, the pressure loss ΔP may be about 0.37 bar, and in a case in which the length of the nozzle 123 is L3, the pressure loss ΔP may be about 0.29 bar.

When the ratio is 1, that is, the inlet/outlet diameters of the nozzle 123 are the same, in a case in which the nozzle length is L1, L2, and L3, the pressure loss ΔP may be about 0.38 bar, about 0.35 bar, and about 0.24 bar. When the ratio is greater than 1, as the ratio increases, the pressure loss ΔP may gradually decrease. For example, in a case in which the length of the nozzle 123 is L1, when the ratio is 2, the pressure loss may slightly increase above the preset or predetermined loss value ΔPa. Also, when the pressure loss corresponds to the preset or predetermined loss value ΔPa, the ratio may be a value A. The value A may correspond to about 2.0. That is, when the length of the nozzle 123 is about 0.5 mm, and the diameter D2 of the outlet 123*b* is about 25 μm, the diameter D1 of the inlet 123*a* may be about 50 μm or more.

As another example, in a case in which the length of the nozzle 123 is L2, when the pressure loss corresponds to the preset or predetermined loss value ΔPa, the ratio may be a value B. The value B may correspond to about 2.8. That is, when the length of the nozzle 123 is about 0.8 mm, and the diameter D1 of the outlet 123*b* is about 25 μm, the diameter D2 of the inlet 123*a* may be about 70 μm or more.

As another example, in a case in which the length of the nozzle 123 is L2, when the pressure loss corresponds to the preset or predetermined loss value ΔPa, the ratio may be a value C. The value C may correspond to about 3.8. That is, when the length of the nozzle 123 is about 1.2 mm, and the diameter D2 of the outlet 123*b* is about 25 μm, the diameter D1 of the inlet 123*a* may be about 95 μm or more.

In summary, in this embodiment, when the length of the nozzle 123 is selected as one value of L1 to L3, the ratio may be 2 or more so as to maintain the pressure loss at the nozzle 123 to the preset or predetermined loss value ΔPa or less. Also, as the length of the nozzle 123 increases, the ratio may increase (A<B<C) to maintain the pressure loss to the preset or predetermined loss value ΔPa or less.

Figure 10:
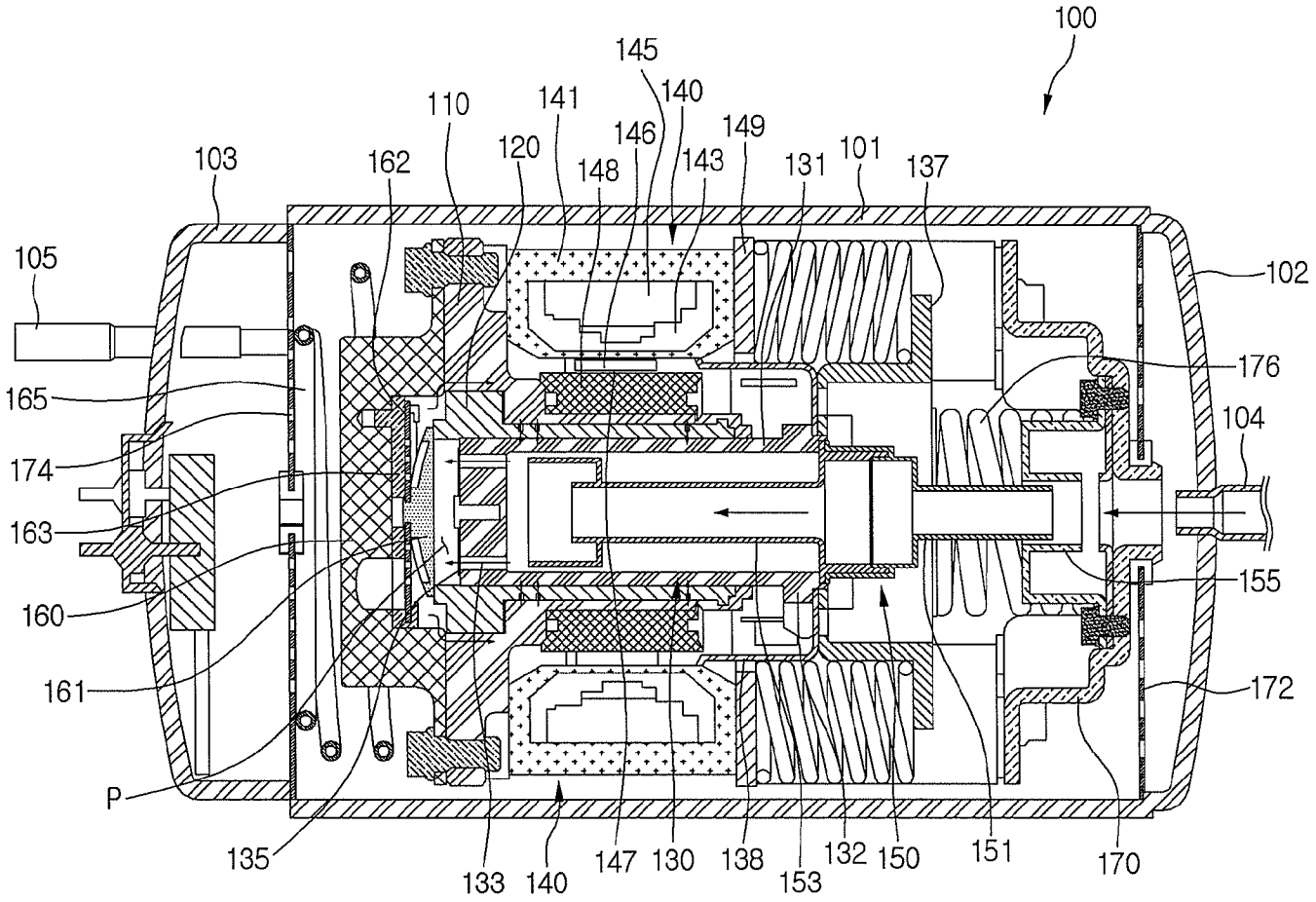
FIG. 10 is a cross-sectional view illustrating refrigerant flow in the linear compressor according of FIG. 1.

FIG. 10 is a cross-sectional view illustrating refrigerant flow in the linear compressor of FIG. 1. Referring to FIG. 10, refrigerant flow in the linear compressor according to embodiments will be described hereinbelow.

Referring to FIG. 10, the refrigerant may be introduced into the shell 101 through the suction inlet 104 and flow into the suction muffler 150 through the suction guide 155. The refrigerant may be introduced into the second muffler 153 via the first muffler 151 of the suction muffler 150 to flow into the piston 130. In this process, suction noise of the refrigerant may be reduced.

A foreign substance having a predetermined size (about 25 μm) or more, which is contained in the refrigerant, may be filtered while passing through the first filter 310 provided on the suction muffler 150. The refrigerant within the piston 130 after passing though the suction muffler 150 may be suctioned into the compression space P through the suction hole 133 when the suction valve 135 is opened.

When the refrigerant pressure in the compression space P is above the discharge pressure, the discharge valve 161 may be opened. Thus, the refrigerant may be discharged into the discharge space of the discharge cover 160 through the opened discharge valve 161, flow into the discharge outlet 105 through the loop pipe 165 coupled to the discharge cover 160, and be discharged outside of the compressor 100.

At least a portion of the refrigerant within the discharge space of the discharge cover 160 may flow toward the outer circumferential surface of the cylinder body 121 via the space defined between the cylinder 120 and the frame 110, that is, the inner circumferential surface of the recess 117 of the frame 110 and the outer circumferential surface of the cylinder flange 125 of the cylinder 120. The refrigerant may pass through the second filter 320 disposed between the seat surface 127 of the cylinder flange 125 and the seat 113 of the frame 110. In this process, a foreign substance having a predetermined size (about 2 μm) or more may be filtered. Also, oil in the refrigerant may be adsorbed onto or into the second filter 320.

The refrigerant passing through the second filter 320 may be introduced into the plurality of gas inflows 122 defined in the outer circumferential surface of the cylinder body 121. Also, while the refrigerant passes through the third filter 330 provided on or in the gas inflows 122, a foreign substance having a predetermined size (about 1 μm) or more, which is contained in the refrigerant, may be filtered, and the oil contained in the refrigerant may be adsorbed.

The refrigerant passing through the third filter 330 may be introduced into the cylinder 120 through the nozzle(s) 123 and be disposed between the inner circumferential surface of the cylinder 120 and the outer circumferential surface of the piston 130 to space the piston 130 from the inner circumferential surface of the cylinder 120 (gas bearing). The inlet 123*a* of each nozzle 123 may have a diameter greater than a diameter of the outlet 123*b*. Thus, a refrigerant flow section area of the nozzle 123 may gradually decrease with respect to the flow direction of the refrigerant. For example, the inlet 123*a* may have a diameter greater than two times a diameter of the outlet 123*b*.

As described above, the high-pressure gas refrigerant may be bypassed within the cylinder 120 to serve as the gas bearing with respect to the piston 130 which is reciprocated, thereby reducing abrasion between the piston 130 and the cylinder 120. Also, as oil is not used for the bearing, friction loss due to oil may not occur even though the compressor 100 operates at a high rate.

Also, as the plurality of filters may be provided on a path of the refrigerant flowing into the compressor 100, foreign substances contained in the refrigerant may be removed. Thus, the refrigerant acting as the gas bearing may be improved in reliability. Thus, it may prevent the piston 130 or the cylinder 120 from being worn by the foreign substances contained in the refrigerant. Also, as oil contained in the refrigerant may be removed by the plurality of filters, it may prevent friction loss due to the oil from occurring.

The first, second, and third filters 310, 320, and 330 may be referred to as a "refrigerant filter device" in that the filters 310, 320, and 330 filter the refrigerant that serves as the gas bearing.

According to embodiments, the compressor including inner parts or components may be decreased in size to reduce a volume of a machine room of a refrigerator and increase an inner storage space of the refrigerant in which the compressor is employed. Also, a drive frequency of the compressor may be increased to prevent performance of the inner parts from being deteriorated due to decreased size thereof. In addition, as the gas bearing is applied between the cylinder and the piston, the friction force occurring due to oil may be reduced.

Further, as the nozzle to guide introduction of the refrigerant is provided on the outer circumferential surface of the cylinder, and an optimum value or ratio with respect to inlet/outlet diameters of the nozzle and a length of the nozzle is applied, pressure loss of the refrigerant passing through the nozzle may be minimized, and the cylinder may be maintained at a preset or predetermined rigidity or more. Furthermore, as the plurality of filtering device are provided in the compressor, it may prevent foreign substances or oil contained in the compression gas (or discharge gas) introduced to the outside of the piston from the nozzle of the cylinder from being introduced. More particularly, the first filter may be provided on the suction muffler to prevent the foreign substances contained in the refrigerant from being introduced into the compression chamber. Also, the second filter may be provided on the coupling part or portion between the cylinder and the frame to prevent the foreign substances and oil contained in the compressed refrigeration gas from flowing into the gas inflow of the cylinder. Also, the third filter may be provided on the gas inflow of the cylinder to prevent the foreign substances and oil from being introduced into the nozzle of the cylinder from the gas inflow.

As described above, as foreign substances or oil contained in the compression gas that acts as the bearing may be filtered through the plurality of filtering device provided in the compressor, it may prevent the nozzle of the cylinder from being blocked by the foreign substances or oil. As the blocking of the nozzle of the cylinder is prevented, the gas bearing effect may be effectively performed between the cylinder and the piston, and thus, abrasion of the cylinder and the piston may be prevented.

Embodiments disclosed herein provide a linear compressor in which a gas bearing may easily operate between a cylinder and a piston.

Embodiments disclosed herein provide a linear compressor that may include a shell including a suction part or inlet; a cylinder provided in the shell to define a compression space for a refrigerant; a piston reciprocated in an axial direction within the cylinder; a discharge valve provided on or at one or a first side of the cylinder to selectively discharge the refrigerant compressed in the compression space; and a nozzle part or nozzle, through which at least a portion of the refrigerant discharged through the discharge valve may flow, the nozzle part being disposed in the cylinder. The nozzle part may include an inlet part or inlet, through which the refrigerant may be introduced, and an outlet part or outlet having a diameter less than a diameter of the inlet part.

The nozzle part may be recessed inward from the cylinder in a radial direction from the inlet part toward the outlet part. The nozzle part may extend to have a preset or predetermined length (L), and the inlet part may have a diameter (D1) greater than two times a diameter D2 of the outlet part. As the nozzle increases in preset length (L), a ratio of the diameter (D1) of the inlet part to the diameter (D2) of the outlet part may gradually increase.

When the preset length (L) of the nozzle part is about 0.5 mm, the ratio may be 2 or more. When the preset length (L) of the nozzle part is about 0.8 mm, the ratio may be 2.8 or more. When the preset length (L) of the nozzle part is about 1.2 mm, the ratio may be 3.8 or more.

The linear compressor may further include a gas inflow part or inflow recessed from an outer circumferential surface of the cylinder to communicate with the nozzle part, and a filter member disposed in the gas inflow part. The filter member may include a thread having a preset or predetermined thickness or diameter.

Embodiments disclosed herein further provide a linear compressor that may include a shell including a suction part or inlet; a cylinder provided in the shell to define a compression space for a refrigerant; a piston reciprocated in an axial direction within the cylinder; a discharge valve provided on or at one or a first side of the cylinder to selectively discharge the refrigerant compressed in the compression space; a gas inflow part or inflow, in which a filter member may be disposed, the gas inflow part being recessed from an outer circumferential surface of the cylinder; and a nozzle part or nozzle that extends from the gas inflow part toward an inner circumferential surface of the cylinder. The nozzle part may have a flow cross-section area that gradually decreases with respect to a flow direction of the refrigerant.

The nozzle part may include an inlet part or inlet connected to the gas inflow part, and an outlet part or outlet connected to the inner circumferential surface of the cylinder. The nozzle part may have a preset or predetermined length from the inlet part toward the outlet part.

The outlet part may have a diameter (D2) less than a diameter (D1) of the inlet part. The inlet part may have a diameter (D1) greater than two times the diameter D2 of the outlet part. The filter member may include a thread formed of a polyethylene terephthalate (PET) material.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a shell;

a cylinder provided in the shell to define a compression space for a refrigerant;

a piston reciprocated in an axial direction within the cylinder;

discharge valve provided at one end of the cylinder to selectively discharge the refrigerant compressed in the compression space;

plurality of gas inflows recessed from outer circumferential surface the cylinder, wherein a filter is installed in each of the plurality of gas inflows; and a plurality of nozzles that extends, respectively, from each of the plurality of gas inflows toward an inner circumferential surface of the cylinder, wherein each of the plurality of nozzles has a cross-sectional area that gradually decreases with respect to a flow direction of the refrigerant, wherein each of the plurality of gas inflows has a ring shape, wherein the filter comprises a thread formed of polyethylene terephthalate (PET) material, and wherein the thread is arranged to be wound multiple times in the respective gas inflow.

2. The linear compressor according to claim 1, wherein each of the plurality of nozzles comprises:

an inlet connected to the respective gas inflow; and an outlet at the inner circumferential surface of the cylinder.

3. The linear compressor according to claim 2, wherein a diameter of the outlet is less than a diameter of the inlet.

4. The linear compressor according to claim 3, wherein the diameter of the inlet is greater than two times the diameter of the outlet.

5. The linear compressor according to claim 1, wherein the plurality of nozzles is distributed along circumference of the cylinder.

6. The linear compressor according to claim 1, wherein the plurality of nozzle comprises a plurality of sets of nozzles distributed along a length of the cylinder.

7. The linear compressor according to claim 6, wherein a larger number of nozzles is provided on a discharge side with respect to a central portion of the cylinder than on a suction side.

* * * * *